US010602848B2

(12) United States Patent
Magaña

(10) Patent No.: US 10,602,848 B2
(45) Date of Patent: Mar. 31, 2020

(54) THEATER SEATING SYSTEM WITH RECLINING SEATS AND COMFORT DIVIDER

(71) Applicant: Enrique Ramirez Magaña, Morelia (MX)

(72) Inventor: Enrique Ramirez Magaña, Morelia (MX)

( * ) Notice: Subject to any disclaimer, the term of this patent is extended or adjusted under 35 U.S.C. 154(b) by 381 days.

(21) Appl. No.: 15/185,798

(22) Filed: Jun. 17, 2016

(65) Prior Publication Data

US 2017/0020291 A1 Jan. 26, 2017

Related U.S. Application Data

(63) Continuation of application No. 14/164,992, filed on Jan. 27, 2014, now Pat. No. 9,370,248.

(60) Provisional application No. 61/759,120, filed on Jan. 31, 2013.

(51) Int. Cl.

| | |
|---|---|
| ***A47C 7/50*** | (2006.01) |
| ***A47C 1/024*** | (2006.01) |
| ***A47C 1/12*** | (2006.01) |

(52) U.S. Cl.

CPC ..... *A47C 7/506* (2013.01); *A47C 1/024* (2013.01); *A47C 1/12* (2013.01)

(58) Field of Classification Search

CPC ..... A47C 7/506; A47C 1/12; A47C 1/024

USPC .. 297/249, 243, 232, 423.1, 423.15, 440.14, 297/248, 423.41, 217.6; 52/8; 312/198, 312/201, 203, 235.5; 4/254; D6/353; 248/118; 5/651, 648; 244/118.6

See application file for complete search history.

(56) References Cited

U.S. PATENT DOCUMENTS

| | | | | |
|---|---|---|---|---|
| 2,267,158 | A * | 12/1941 | Locke | A47L 23/205 297/188.08 |
| 3,213,570 | A * | 10/1965 | Abramson, Jr. | A47C 11/00 108/161 |
| 5,101,526 | A * | 4/1992 | Smith | A47C 20/021 5/421 |
| 5,335,962 | A * | 8/1994 | Gera | A47C 13/005 297/135 |
| 5,915,783 | A * | 6/1999 | McDowell | A47C 1/12 219/217 |
| 6,739,670 | B2 * | 5/2004 | Johnson | A47B 9/00 108/147 |
| 2006/0065422 | A1 * | 3/2006 | Broyles | H01R 13/639 174/53 |
| 2012/0200129 | A1 * | 8/2012 | Wilson, Jr. | A47C 7/72 297/217.3 |

* cited by examiner

*Primary Examiner* — Milton Nelson, Jr.
(74) *Attorney, Agent, or Firm* — Lott & Fischer, PL

(57) ABSTRACT

A comfort divider for use in a seating system for improved user comfort and convenience while maximizing auditorium floor space utilization. The comfort divider is comprised of foot rest assemblies and recliner backstop assemblies arranged in an alternating fashion.

3 Claims, 4 Drawing Sheets

THEATER SEATING SYSTEM WITH RECLINING SEATS AND COMFORT DIVIDER

This application is a continuation of U.S. patent application Ser. No. 14/164,992, filed Jan. 27, 2014, now U.S. Pat. No. 9,370,248, which claims the benefit of U.S. Provisional application Ser. No. 61/759,120, filed Jan. 31, 2013, each of which is incorporated by reference in its entirety herein, and from which priority is claimed.

FIELD OF INVENTION

The invention relates to a seating system to be used in auditoria, such as motion picture theaters, amphitheaters, classrooms, theater houses, and the like. Among the novel aspects of the disclosed seating system, is its suitability for providing improved user comfort and convenience while maximizing auditorium floor space utilization.

BACKGROUND OF THE INVENTION

In general, theater or auditorium seats are designed to maximize the number of seats in a theater while providing a comfortable seat for the patron. Some seats recline and include cup holders and/or trays. Additionally, some seats include an area for the patron to store food or personal items.

There have been advancements in theater seating to accommodate new technology in motion and sound. There have also been advancements in theater seating to accommodate theater dining However, there have been limited advancements in providing comforts, such as foot rests, in standard, non-premium, or "VIP" auditorium seating while maximizing the floor space being utilized.

People like to put their feet up in order to be comfortable and to relax. The cinema is a place where people like to be comfortable while they watch a movie. Some theaters provide VIP seating for patrons who pay a premium for reclining leather chairs with foot rests and other additional upgraded features and amenities, such as tables and storage areas for personal effects. Typically, the reclining armchair requires a two (2) meter footprint to function properly while allowing for room for service waiters and other patrons. However, not all patrons wish or are able to pay for VIP seating. Moreover, not all theaters can accommodate dedicating such a large amount of space to VIP seating.

Therefore, there is a need in the art for auditoria seating that provides improved user comfort and convenience while maximizing auditorium floor space utilization. Particularly, there is a need for a comfortable, reclining seat that includes a foot rest while maximizing the number of seats in the auditoria. Such luxurious, comfortable, regular seating will allow an auditorium to have a competitive edge due to its improved quality and comfort for all patrons.

There is a further need in the art for an ergonomic solution to comfortable auditoria seating while using the minimum floor space required.

SUMMARY OF THE INVENTION

The present invention satisfies the needs in the industry by providing a seating system for improved user comfort and convenience while maximizing auditorium floor space utilization. The seating system is composed of two modular components: (1) a reclining theater seat assembly and (2) a comfort divider. The reclining theater seat assembly is comprised of a seating surface, a reclining back, armrests and a support base. The comfort divider is comprised of foot rest assemblies and recliner backstop assemblies in an alternating arrangement. A row of comfort dividers is placed between each row of theater seat assemblies. A comfort divider row may comprise a single unitary assembly, or, like the seat assembly may be comprised of modular assemblies connected together as dictated by space requirements.

The invention provides a seating system comprising a reclining seat assembly and a comfort divider. The reclining seat assemblies can be connected to form a row of seats and the comfort divider is placed between each row of seats. The comfort divider is comprised of foot rest assemblies and recliner backstop assemblies in an alternating arrangement. The foot rest assemblies are each comprised of a shelf-like structure that is open in a rear-facing direction to provide multiple levels of foot rests where the user of a seat directly behind the comfort divider may rest his or her feet. The recliner backstop assemblies are each composed of a wall that is optionally slanted to form a recess to receive the reclining back of a seat assembly in front of the comfort divider.

Therefore, it is an object of the present invention to provide a comfortable, reclining seat that includes a foot rest while maximizing the number of seats that fit within the auditoria. The foot rest is not part of the reclining seat, but rather is part of a dividing wall or comfort divider that is found in front of the seats. The comfort divider also serves as recliner backstop to prevent the row of seats in front of the divider from being reclined too far and interfering with patrons seated behind.

These and other objects, features, and advantages of the present invention may be better understood and appreciated from the following detailed description of the embodiments thereof, selected for purposes of illustration and shown in the accompanying drawings.

DETAILED DESCRIPTION

Figure 1:
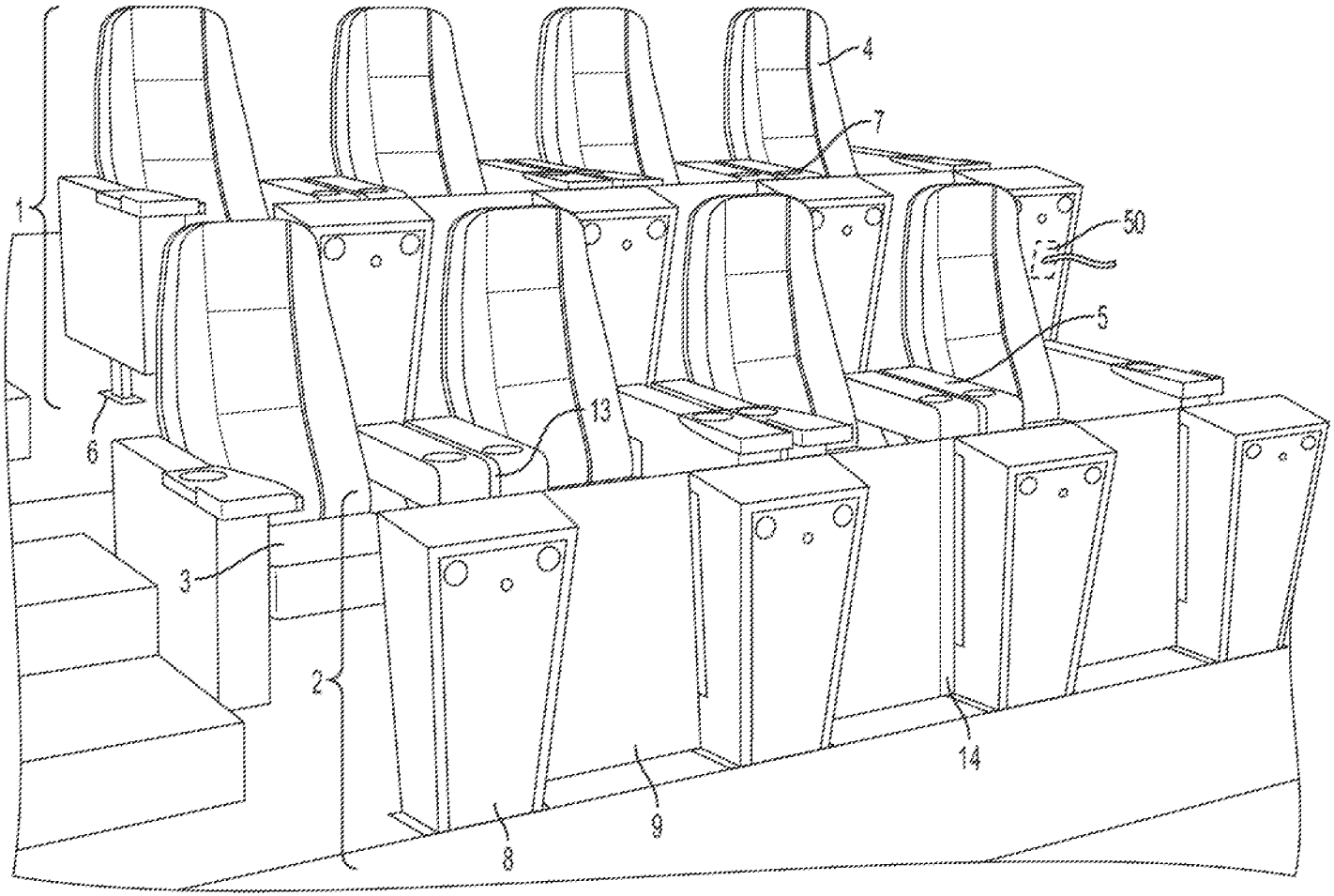
FIG. 1 is a frontal perspective view of the seating system of the present invention.
Figure 2:
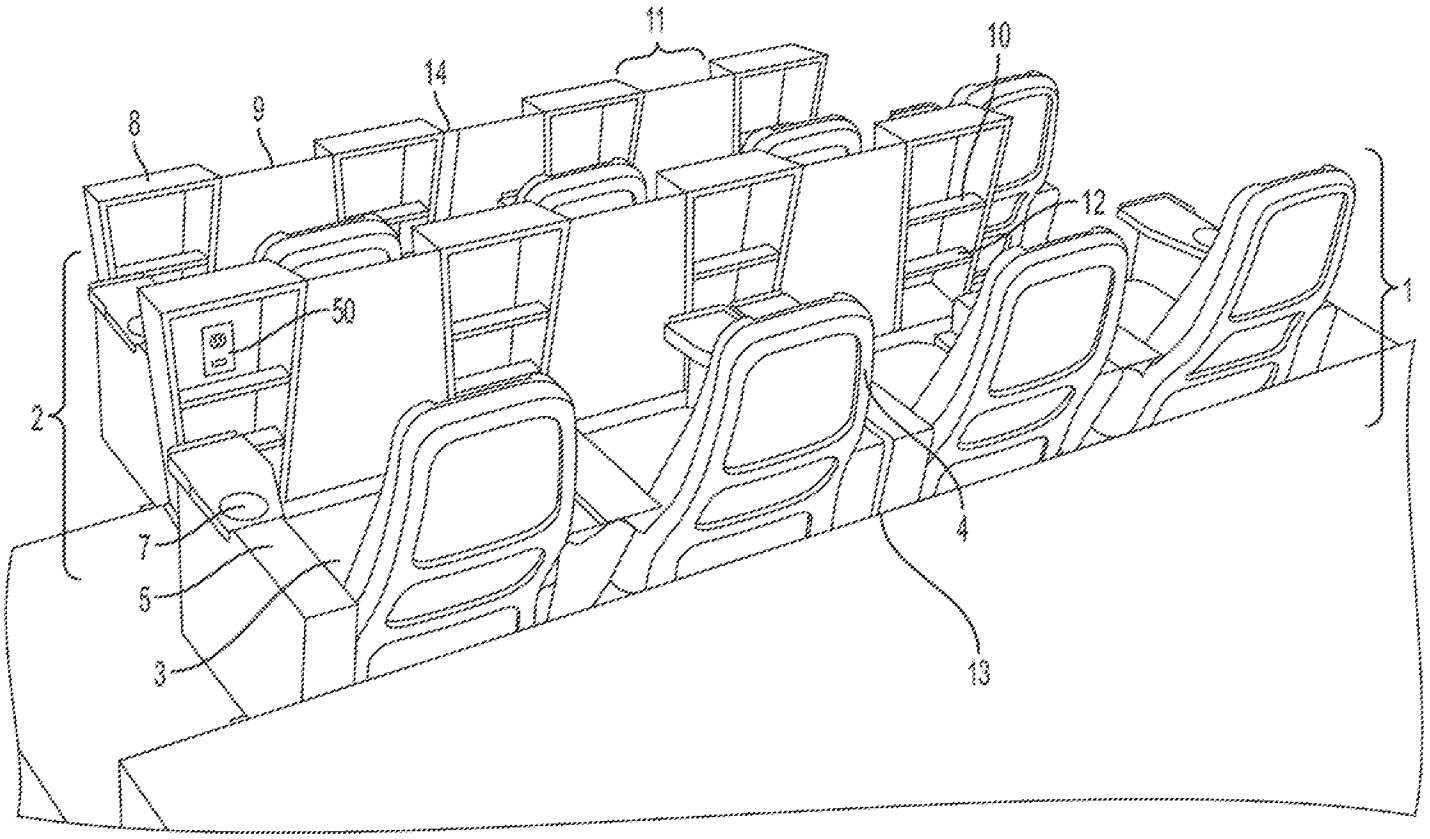
FIG. 2 is a rear perspective view of the seating system of the present invention.

Embodiments of the invention are illustrated in the accompanying drawings. FIG. 1 is a frontal perspective view of the seating system and FIG. 2 is a rear perspective view of the seating system. The seating system can be used in auditoria, such as motion picture theaters, amphitheaters, classrooms, theater houses, and the like. The term "theater seating" as used herein, shall be understood to refer to seating that could be used in an auditorium, picture theaters, amphitheaters, classrooms, theater houses, and essentially in any place where one desires to employ such seating arrangements. Among the novel aspects of the disclosed seating system, is its suitability for providing improved user comfort and convenience while maximizing auditorium floor space utilization.

The disclosed seating system includes two basic modular components that can be arranged in a variety of configurations to suit the dimensions and geometry of the auditorium where they will be installed.

As shown in FIGS. 1 and 2, the first of the modular components is the reclining theater seat assembly 1 (also referred to herein as a "seat assembly") which is comprised of a seating surface 3, a reclining back 4, at least one armrest 5 and a support base 6. Additional comfort features may be incorporated into the seat assembly 1, such as cup holders 7, retractable tables, personal lamps, as well as other known comfort features. Multiple modular seat assemblies 1 may be connected to form a row of seats with a seat pitch determined by the width of each seat assembly 1. The seat pitch may also be increased or decreased by the insertion or removal of spacers 13 between seats 1 in a row. Additional variations of the seat assembly 1 may include a "double seat" assembly which minimizes the number of seat assemblies 1 that need to be connected in order to form a row, as well as a "row end" assembly to be optionally installed at one or both of the extreme ends of each seating row.

The second of the modular components is a comfort divider 2 that is intended for placement between each row of theater seats 1. The comfort divider 2 is comprised of foot rest assemblies 8 and recliner backstop assemblies 9 in an alternating arrangement. The foot rest assembly 8 is comprised of a shelf-like structure 10 that is open in a rear-facing direction (relative to a person sitting on a seat directly behind it) and provides multiple levels of foot rests where the user of a seat may rest his or her feet. The foot rest assembly 8 may also optionally include a storage area for the personal effects of the user. Additionally, the patron may use one of the shelf-like structures 10 as a foot rest and the other shelf-like structure 10 for the storage of personal items. The foot rest assembly 8 may optionally be wired 50 with electricity for lighting or to provide electrical outlets for user's to charge electronic devices when they are put away and stored during the show or performance.

The recliner backstop assembly 9 is primarily composed of a wall that is optionally slanted to correspond to the angle of recline of the seat assembly's back 4. The wall, of course, can be perpendicular to the floor and still serve this purpose. It is envisioned that a wall having a slant angle of 0-30 degrees is suitable to accomplish that purpose, although greater slant angles may also be acceptable and are considered to be within the scope of the present invention. The recliner backstop assembly 9 limits the maximum amount of recline of the seat directly in front of it to prevent too much recline to interfere with the patrons behind it. The wall's top surface forms a recess open in the front-facing direction 11 (relative to a person sitting on a seat directly in front of it) which is adapted to receive the reclining back 4 of a seat assembly in front of it. The wall's bottom surface forms a recess open in the rear-facing direction 12 (relative to a person sitting on a seat directly in front of it) that may include additional storage space for the row of seats directly behind it. The main purpose of the recliner backstop assembly 9 is to prevent the user's seat assembly 1 from reclining too far back and thus impinge onto the legroom of the seats directly behind it.

Multiple recliner backstop 9 and foot rest assemblies 8 may be connected, in an alternating pattern, to form a comfort divider 2 row with a foot rest 8 pitch determined by the combined width of the two assemblies. The foot rest 8 pitch may also be increased or decreased by the insertion or removal of spacers 14 between the assemblies in a row. Under most circumstances, it will be desirable for the seat 3 pitch and foot rest 8 pitch to be identical.

Figure 3:
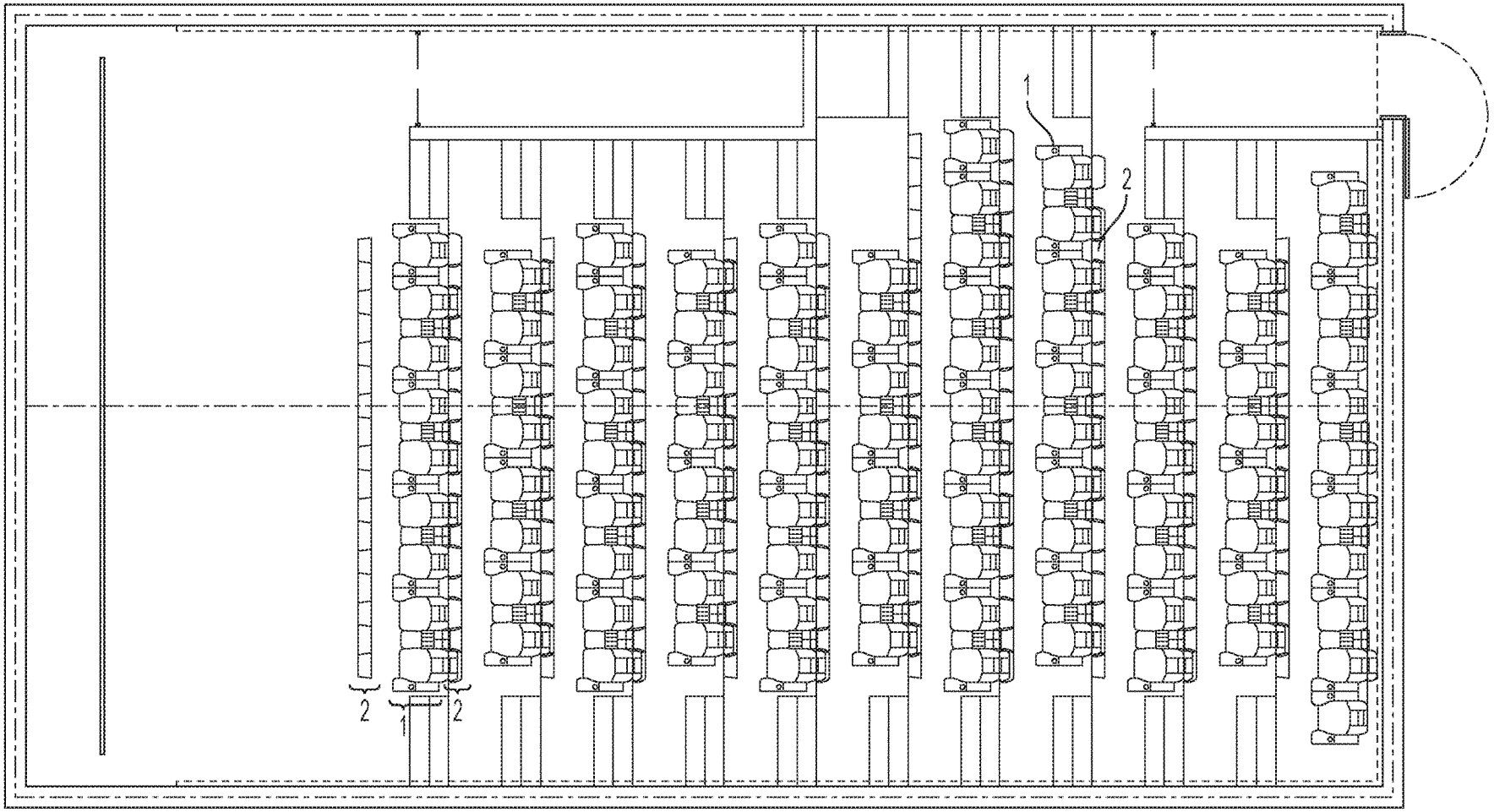
FIG. 3 is a top view of an auditorium with the seating system of the present invention installed.

As shown in FIGS. 1, 2 and 3, in operation the disclosed seating system is installed in an auditorium by placing a rearmost row of reclining theater seat assemblies 1 facing the front of the auditorium with a corresponding comfort divider row 2 immediately in front of the row of reclining theater seat assemblies 1. The distance between the row of theater seat assemblies 1 and the comfort divider row 2 is variable and depends on the configuration of the auditorium and the amount of legroom that the user is to be provided.

The components of the comfort divider row 2 are arranged and configured so that each seat assembly 1 has a corresponding foot rest assembly 8 directly in front of it and the recliner backstop assembly 4 is located diagonally between each of the seats.

The next row of reclining theater seat assemblies 1 and comfort dividers 2 is installed in front of the rearmost row of theater seat assemblies 1 and comfort dividers 2 but is staggered horizontally relative to the rearmost row so that the reclining back 4 of each seat assembly 1 corresponds to a recliner backstop assembly 9 directly behind it. Additional rows of seat assemblies 1 can then be installed in similar fashion until the entire seating surface of the auditorium is filled. The arrangement of seats in a staggered fashion also ensures the visibility of all patrons in any position. In other words, in this arrangement, no patron would have another patron directly in front, thus minimizing the possibility of a patron's head blocking the visibility of a patron in the row directly behind.

The various rows of theater seat assemblies 1 and row dividers 2 can be located on a level surface, or, in a "stadium seating" configuration, the rows may be installed on a downward stepped arrangement from back to front, creating a less obstructed sightline to the front of the auditorium.

In one embodiment, stadium style seating is used on a staggered slab. The footprint of the seating system is 1.40 m, which includes a theater seat assembly 1 and a row divider 2 with an incline of 0.45 m for each level of row of seats. In this embodiment, the allotted space for the seat 3, reclining back 4, foot rest assembly 8 and aisle are as follows: the seat 3 is 0.50 m, the reclining back 4 is 0.15 m, the space into which to recline is 0.15 m, the foot rest 8 is 0.15 m, and the aisle is 0.45 m. The total space to be used by one theater seat assembly 1 and comfort divider 2 with the foot rest 8, also known as the "footprint", is 1.40 m. The footprint for the theater seating assembly 1 and comfort divider 2 with the foot rest 8 on a same level slab is also 1.40 m. The 1.40 m footprint of the present seating system provides a significant improvement in maximizing the use of floor space when compared to the typical VIP seating footprint of 2.0 m per seat.

The present seating system provides several advantages. Namely, the comfort of a foot rest 8 is provided to the patron without the patron having to pay for a VIP ticket price. The present seating system also provides the luxuries of the VIP experience, such as a foot rest 8, side table, folding arm rest 5, ergonomic seating 3, reclining back 4 rest, and shelving 10 for storing personal items and/or food. The seating system also provides the auditorium with greater profitability as the area of seats is optimized to reduce the footprint of VIP seating, which takes up significantly more floor space. The present seating system is designed to be a lower cost investment than that incurred with VIP seating. The theater seating system optimizes the floor space used to provide the patron with the greatest amount of room while being economically beneficial to the theater owner.

Figure 4:
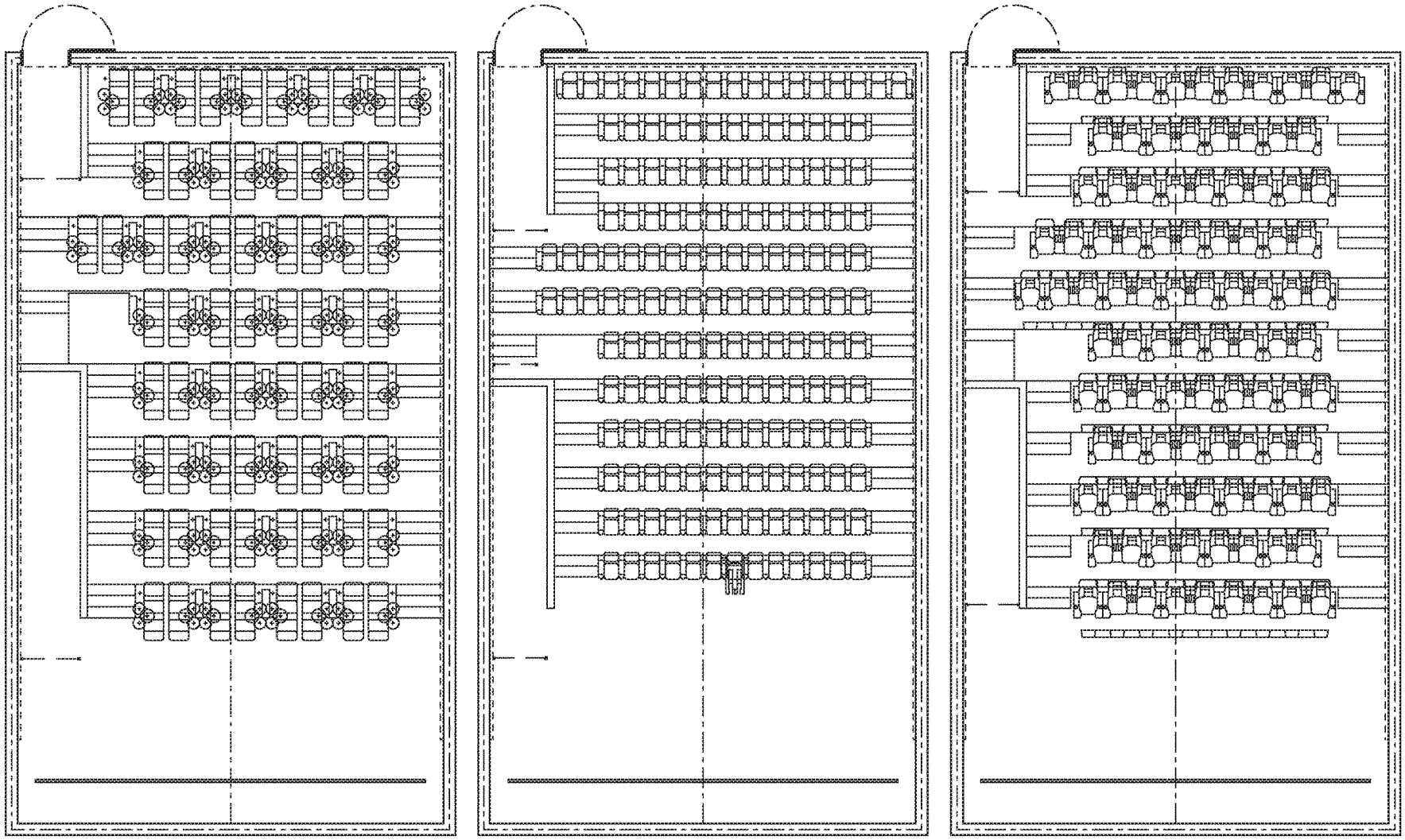
FIG. 4 is a top view comparing three auditoria using different seating systems, namely, (a) a traditional VIP seating system, (b) a traditional non-VIP seating and (c) a seating system according to the present invention.

FIG. 4 is a top view comparing three auditoriums using different seating systems, namely, auditoriums with (a) traditional VIP seating, (b) traditional non-VIP seating and (c) seating in accordance with the present invention. As shown, the present theater seating system efficiently uses 64% of the profitable, available floor space. While a typical VIP theater seating would use about 40% of profitable, available floor space and a traditional non-VIP theater uses 100% of profitable, available floor space. This assumes that the auditorium is approximately 252 $m^2$, the first row distance from the screen is 7 m, the side aisles are 1.50 m each. Accordingly, the present theater seating system offers a significant economic advantage over the VIP seating, while still providing the VIP experience.

The theater seating system can employ a wide variety of upholstery. The seating surface 3 and reclining back 4 can be made of any known suitable material, such as durable fabric, vinyl, or leather. The armrests 5 can include a fixed table or a swinging table or tray. The comfort divider 2 and foot rest 8 can be composed of any known suitable material, such as aluminum, stainless steel, fiberglass, plywood, laminated wood, leather and/or textiles.

In one embodiment of the theater seating system, the following dimensions are used for the foot rest assembly 8 of the comfort divider 2: the top width is 0.40 m, the base width is 0.29 m, the comfort divider 2 is 0.69 m high, it is 0.19 m deep, the first foot rest or shelf 10 is 0.21 m high and the second foot rest or shelf 10 is 0.40 m high. The interior may be composed of any decorative and/or durable material. One such material is textured neoprene with a zigzag design. The foot rest 8 and/or the comfort divider 2 may further include a hook loop for hanging and storing bags or purses.

Embodiments of the seating system have been disclosed by way of example. However, it shall be understood that the two basic modular components, namely the reclining seat assembly and the comfort divider, may be arranged in a variety of configurations. The components can also be composed of a wide variety of known materials such as wood, leather, laminated steel, and the like. All of these variations can be modified to suit the dimensions and geometry of the auditorium where they will be installed.

Although the invention is illustrated in detail in the accompanying figures and examples and described herein, various modifications and structural changes may be made therein without departing from the spirit of the invention and within the scope and range of equivalents of the disclosed designs.

What is claimed is:

1. A comfort divider comprising:

a plurality of foot rest assemblies and a plurality of backstop assemblies, wherein said foot rest assemblies and said backstop assemblies are arranged in alternating fashion and adjacent to one another;

one or more of said foot rest assemblies further comprising wiring adapted to provide electricity for lighting or for electrical outlets; and one or more spacers, each of said spacers being located between one of said backstop assemblies and an adjacent one of said foot rest assemblies, said one or more spacers increasing the distance between said backstop assembly and said adjacent foot rest assembly.

2. The comfort divider of claim 1 wherein each of said foot rest assemblies comprises one or more open shelves.

3. The comfort divider of claim 1 wherein each of said backstop assemblies comprises a wall that is slanted to form an open recess.

* * * * *